US005636849A

United States Patent [19]

Jonsson et al.

[11] Patent Number: 5,636,849

[45] Date of Patent: Jun. 10, 1997

[54] TRANSLATABLE BEARING STUFFING BOX

[75] Inventors: Lennart Jonsson; Björn Karlsson, both of Karlstad, Sweden

[73] Assignee: Kvaerner Pulping AB, Sweden

[21] Appl. No.: 376,038

[22] Filed: Jan. 20, 1995

Related U.S. Application Data

[62] Division of Ser. No. 228,668, Apr. 18, 1994, abandoned.

[30] Foreign Application Priority Data

Jan. 24, 1994 [SE] Sweden ..... 9400215

[51] Int. Cl.[6] ..... F16J 15/06; F16C 23/00; F16C 33/72

[52] U.S. Cl. ..... 277/100; 277/102; 277/174; 277/178; 384/149; 384/192

[58] Field of Search ..... 277/102, 100, 277/178, 174; 384/149, 192

[56] References Cited

U.S. PATENT DOCUMENTS

| | | | |
|---|---|---|---|
| 558,262 | 4/1896 | Darling | 277/100 |
| 3,090,631 | 5/1963 | Hoover | 277/174 |
| 3,240,502 | 3/1966 | Snyder | 277/100 |
| 3,289,791 | 12/1966 | Ulinski | 277/100 |
| 3,348,390 | 10/1967 | Richter | 68/181 |
| 3,815,386 | 6/1974 | Gullichsen et al. | 68/181 R |
| 3,887,196 | 6/1975 | Renfrow | 277/174 |
| 4,637,878 | 1/1987 | Richter et al. | 210/388 |
| 4,881,286 | 11/1989 | Richter et al. | 8/156 |

FOREIGN PATENT DOCUMENTS

| | | | |
|---|---|---|---|
| 514997 | 7/1955 | Canada | 277/100 |
| 340216 | 11/1971 | Sweden | D21C 9/10 |
| 342271 | 1/1992 | Sweden | D21C 9/10 |
| 583225 | 12/1977 | U.S.S.R. | D21C 9/00 |
| 589312 | 2/1978 | U.S.S.R. | D21B 1/02 |
| 773870 | 5/1957 | United Kingdom | 277/100 |

*Primary Examiner*—William A. Cuchlinski, Jr.
*Assistant Examiner*—John L. Beres
*Attorney, Agent, or Firm*—Seed and Berry LLP

[57] ABSTRACT

The invention relates to a diffuser (1), comprising a substantially cylindrical, vertical container (2), through which cellulose pulp is arranged to be transported, nozzle arms (6, 7) for delivering a fluid, such as washing liquid, to the pulp, concentrically disposed screen surfaces (3, 4) and screen arms (5) disposed on and connected to the said screen surfaces for withdrawal of the said fluid. The screen arms are provided, at their outer ends, with withdrawal pipes (26), directed substantially vertically downwards, which are slidably controlled and are connected in sealing arrangement to outlets for the said fluid. The invention relates also to a stuffing box designed to receive a rod, preferably a pull rod (29) for raising and lowering a screen pack having screen surfaces (3, 4) in a diffuser, the said rod being guided in sealing arrangement and slidably through a fixture (35; 35') which is mounted in a bearing for free movement in a plane substantially perpendicular to the said rod. The bearing comprises a radially directed bearing flange (44; 44') extending around the said fixture, which bearing flange is mounted between two radially directed retaining flanges (39, 42; 39', 42') extending around the said fixture.

14 Claims, 6 Drawing Sheets

TRANSLATABLE BEARING STUFFING BOX

CROSS REFERENCE TO RELATED APPLICATION

This application is a divisional of U.S. patent application, Ser. No. 08/228,668, filed Apr. 18, 1994, now abandoned.

TECHNICAL FIELD

The present invention relates to a diffuser, comprising a substantially cylindrical, vertical container, through which cellulose pulp is arranged to be transported, nozzle arms for delivering a fluid, such as washing liquid, to the pulp, concentrically disposed screen surfaces and screen arms disposed on and connected to the said screen surfaces for withdrawal of the said fluid, and relates also to a stuffing box designed to receive a rod, which rod is guided slidably and in a sealing arrangement through the said stuffing box.

BACKGROUND OF THE INVENTION

A device of the type stated in the introduction is shown and described in Swedish patent SE-B-342271, which relates to a device for bleaching cellulose pulp. The withdrawal of the bleaching liquid is here carried out through boxes which are disposed on the outer side of the container and into which there extend the screen arms provided, at their outer ends, with withdrawal holes. Recesses in the wall of the container are covered by plates disposed on the boxes. This construction of the diffuser gives rise to heavy leakage from the container. Moreover, the raising and lowering device for the screen pack is disposed on the bottom side of the arm of the screen pack and is constituted by a piston and cylinder assembly, the piston rod of which is fixed to a pull rod which is fastened via a ball joint to the screen arm. The screen pack is controlled in the upward and downward movement via a bush around the withdrawal pipe or by a separate control system. There is herein a strong risk of the entire screen pack becoming crooked, resulting in the pull rod being bent with the stuffing box as the breaking point, whereby the control bush is exposed to bending forces. The damage which can arise if the screen pack should tilt increases the wear on the equipment, leading rapidly to operating breakdowns.

SE-B-340 216 has previously disclosed a cellulose-bleaching tower having an axially movable screen pack, in which devices in the form of hydraulic cylinders for raising and lowering the screen packs are disposed above the screen arms. In the case of this previously known bleaching tower, the piston rod of the hydraulic cylinder is guided through a bush, as a result of which leaking hydraulic liquid can trickle down in the bush. Withdrawal is further carried out by means of boxes disposed on the contacting surface of the container as is also known from SE-B-342 271.

SUMMARY OF THE INVENTION

The object of the present invention is to produce a diffuser in which the above-stated drawbacks are eliminated and which is dimensioned for very high capacity i.e. pulp throughput per unit of time.

A further object of the invention is to produce a diffuser in which leakage from the casing of the container, such as during withdrawal, is minimized.

The above-stated objects are achieved by a diffuser in which the screen arms, at their outer ends, are provided with withdrawal pipes, directed substantially vertically downwards, which are slidably controlled and are connected in sealing arrangement to outlets for the said fluid. Such a diffuser is the subject of a Swedish Patent Application, Serial No. 9400215-1, entitled DIFFUSER, filed Jan. 24, 1994, from which priority has been claimed, and which is hereby incorporated in its entirety by reference thereto.

The object is achieved also by a stuffing box, in which a circumferential, radially directed bearing flange is mounted in sealing arrangement between at least two radially directed, circumferential flanges fixed to the bush.

Preferred embodiments of the invention have been given those characteristics which are evident from the subclaims.

BRIEF DESCRIPTION OF THE DRAWINGS

The invention is described in greater detail below with reference to appended drawings showing preferred embodiments, in which.

DETAILED DESCRIPTION OF THE INVENTION

Figure 1:
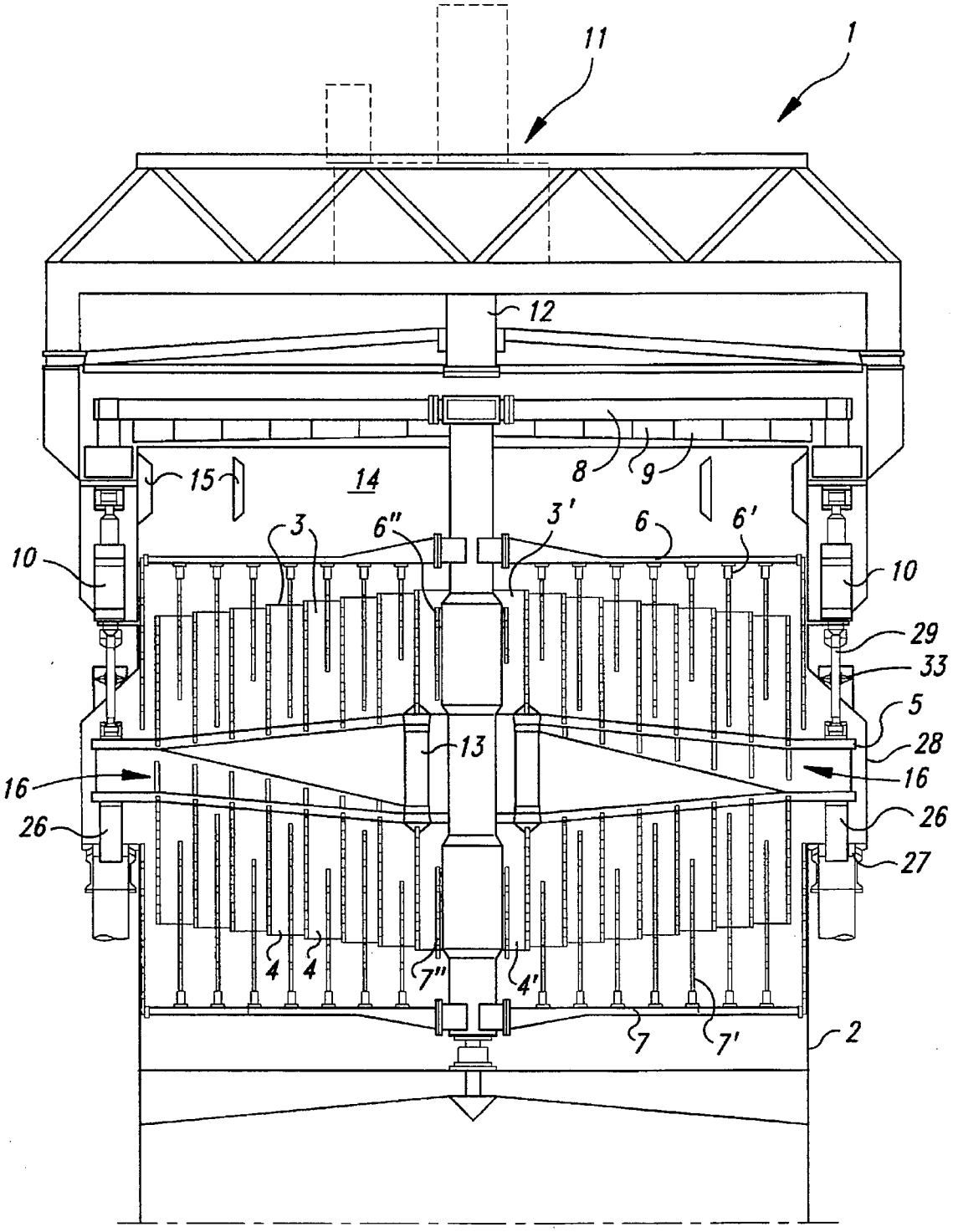
FIG. 1 shows a section along a longitudinal axis of a diffuser according to the invention.
Figure 2:
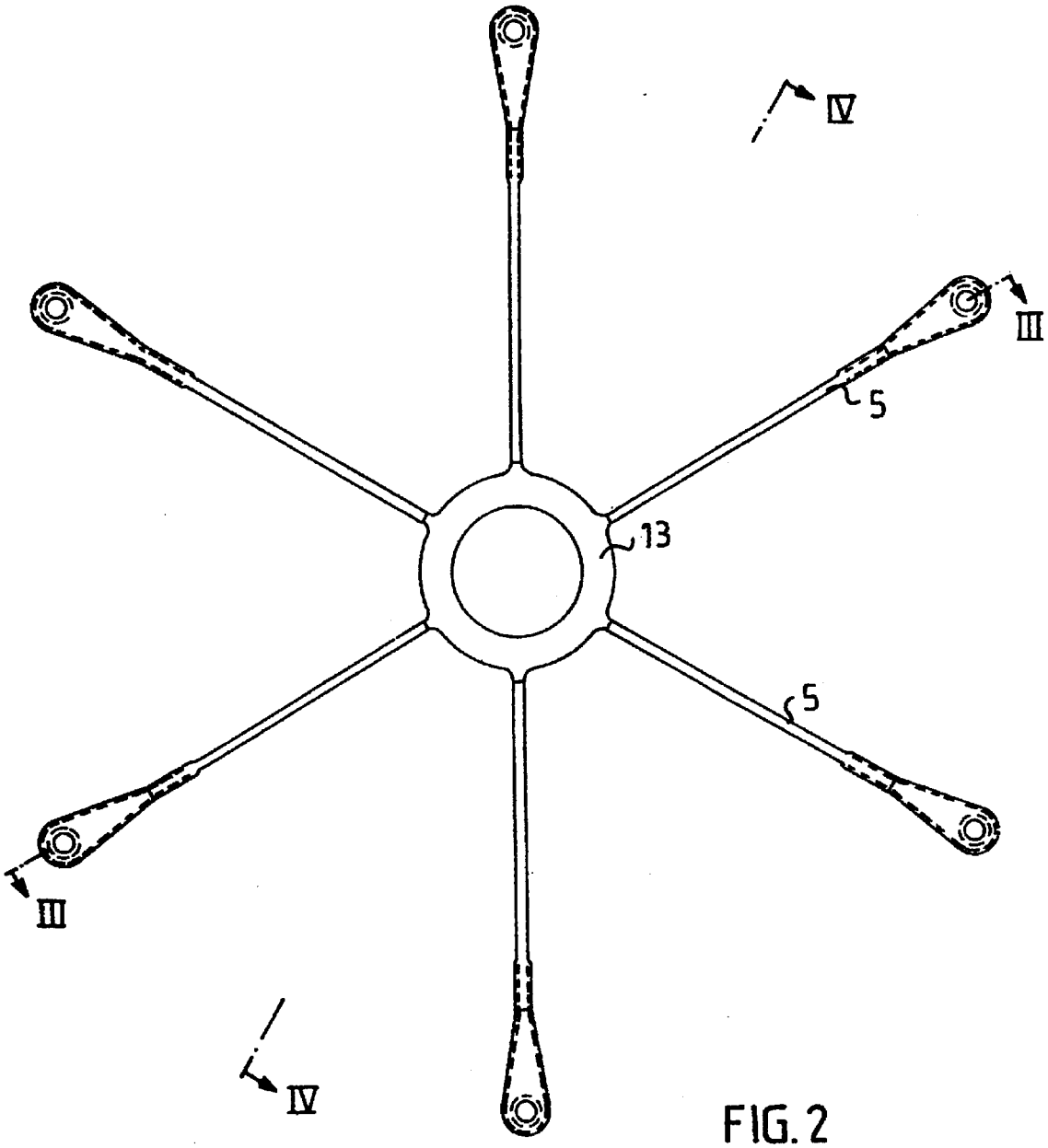
FIG. 2 shows a cross-section through a spider having screen arms, in which connected screen rings and other parts of the diffuser according to the invention have been omitted for the sake of clarity.
Figure 3:
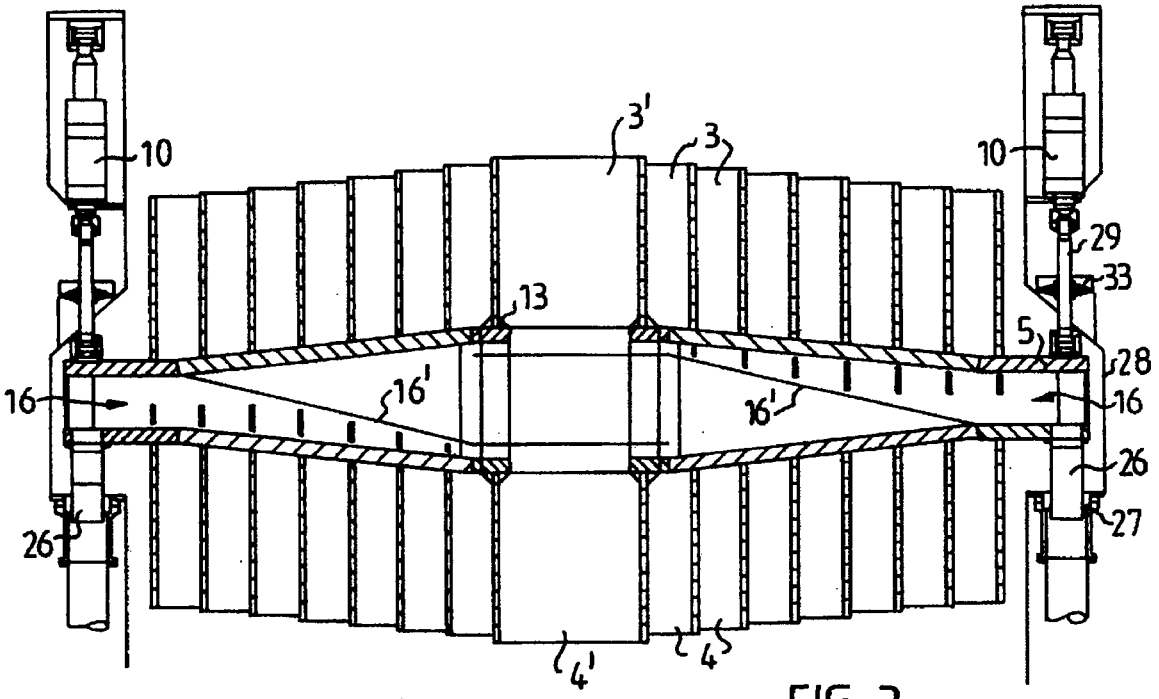
FIG. 3 shows a section through a screen ring pack along the line III—III in FIG. 2.
Figure 4:
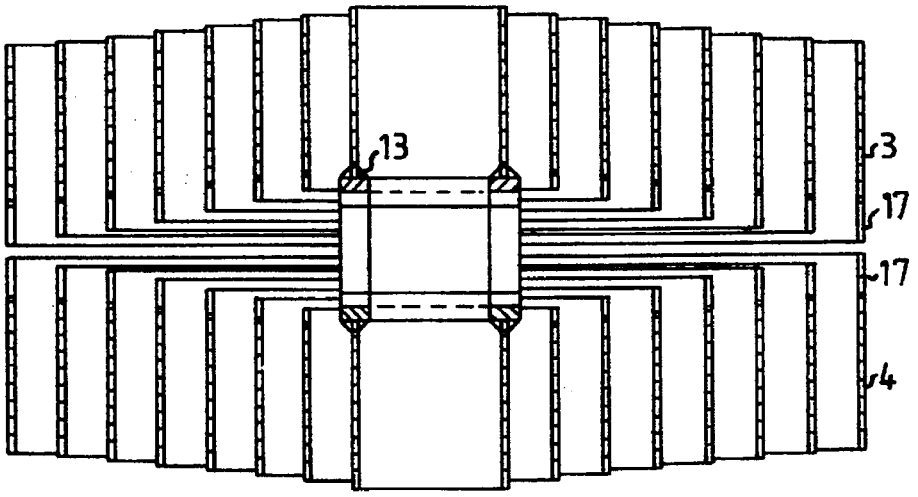
FIG. 4 shows a section through the screen ring pack along the line IV—IV in FIG. 2.
Figure 5:
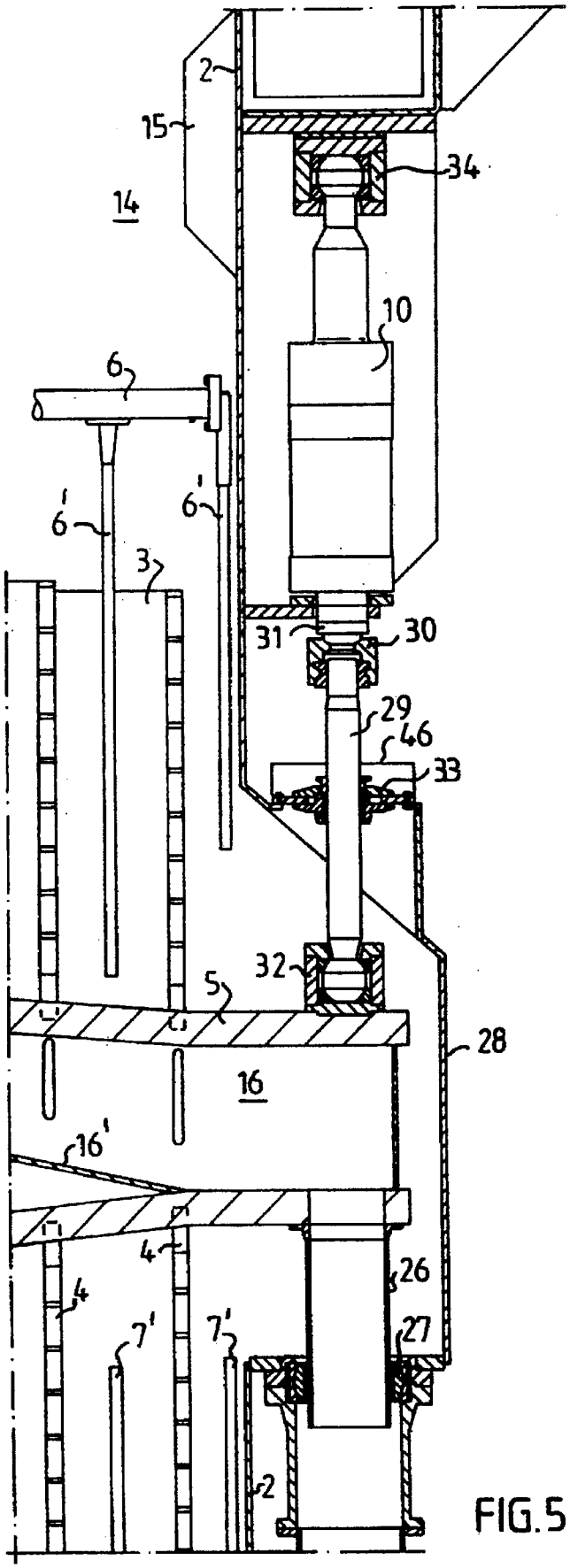
FIG. 5 shows a partial section of the diffuser according to the invention through the end of one of the screen arms.

A diffuser 1 according to the invention, shown in FIGS. 1–5, comprises a container 2, a screen pack having upper and lower screen rings 3 and 4 and screen arms 5, upper and lower nozzle arms 6 and 7 having nozzles 6' and 7', respectively, for delivering fluid, such as washing liquid, a scraping arm 8 of the ring-scraper type having scrapers 9, hydraulic piston and cylinder assemblies 10, distributed along the periphery of the container 2, for axial raising and lowering of the screen pack, and a drive device 11, indicated by dashed lines, for rotation of a centre axle 12 and of the nozzle and scraper arms 6, 7 and 8 which are fixed on the said centre axle. A piston and cylinder assembly 10 for axial raising and lowering of the screen pack is preferably disposed at the outer end of, and above, each screen arm 5. The six screen arms 5 disposed on the diffuser 1 according to the invention are illustrated in FIG. 2 and are connected and are in fluid connection with the screen rings 3, 4 in the screen pack. The screen arms are radially directed from an annular hub 13. The number of screen arms 5 is not limited to the number shown in the preferred illustrative embodiment, but can be varied within the scope of the appended patent claims. The same also applies, of course, to the number of screen rings and number of nozzles.

The scraping arm 8 having scrapers 9 is not provided with nozzles, as in previously known diffusers, but has been designed merely to transport cellulose pulp. This transportation can be carried out radially out to launder and in launder to outlet chutes. This enables the scraping device to be optimized for pulp transportation. The upper nozzles 6' are placed on a separate arm 6 below the scraping arm 8.

Between the nozzle and scraping arms 6 and 8 there is formed a space 14. In this space 14, the inner wall of the container is provided with anti-rotation plates 15 to prevent the pulp from being brought into rotation by the rotating nozzle and scraping arms. During running, a pulp layer is formed here, which produces a reduced change in level during back-flushing and when the screen pack performs a return stroke. The unbroken pulp layer also dampens the formation of gas at the screen rings. By virtue of the upper nozzle arms 6 and the scraping arms 8 being separated, the nozzles 6' are therefore unable to cut grooves in the pulp. This is particularly important in the case of high pulp concentration, where air is able to force its way down through the pulp and reach the screen pack. The pulp layer forms an effective cap, which is very important when operating with a relatively high pulp concentration. As a result of this measure, the upper and lower screen units in the screen pack now operate under equivalent conditions, which, in turn, produces more stable running.

The nozzle arm 7 having the nozzles 7' is matched to the intended flow of fluid and at each end there is formed at least one opening. This means that the entire arm is flowed through by fluid and the risk of blockage at the outer opening is minimized. The nozzles are shorter, moreover, which reduces the load on them.

The screen pack has a conical arm 5, in which the cross-section of the inner withdrawal space 16 diminishes towards the centre of the diffuser. The arm 5 is provided internally with guide plates 16', which demarcate the withdrawal space for the fluid. Three of the arms form the outlets of the upper screen unit and are configured as shown in the right portion of FIG. 3, whilst the three other arms are configured as shown in the left portion of FIG. 3 and form outlets for the lower screen unit. The arms are distributed along the periphery of the diffuser in such a way that the withdrawal space in every other arm is connected to the upper 3 and every other to the lower 4 screen rings. The diameters of the screen rings 3, 4 have been matched to the diameters belonging to the screen rings in a screen pack having only upper screen rings. In the screen pack, a collecting space for withdrawal fluid, or header 17, is disposed along that edge of the upper and lower screen rings 3 and 4 which faces the withdrawal space 16. The diameter of each screen ring is equal for a diffuser having a screen pack having only upper or lower screen rings. The dimensions of the screen pack are adapted according to the particular flow. The withdrawal space 16 can be placed under or over the screen ring or, in the case of a double screen pack, between the screen rings. This construction of the screen pack results in the flow-paths being optimized, so that the liquid volume and gas volume in the screen pack are minimal. In the preferred embodiment, a double screen pack has been provided and the screen arms 5 disposed therebetween are provided with internal withdrawal spaces 16 according to the above.

Figure 6B:
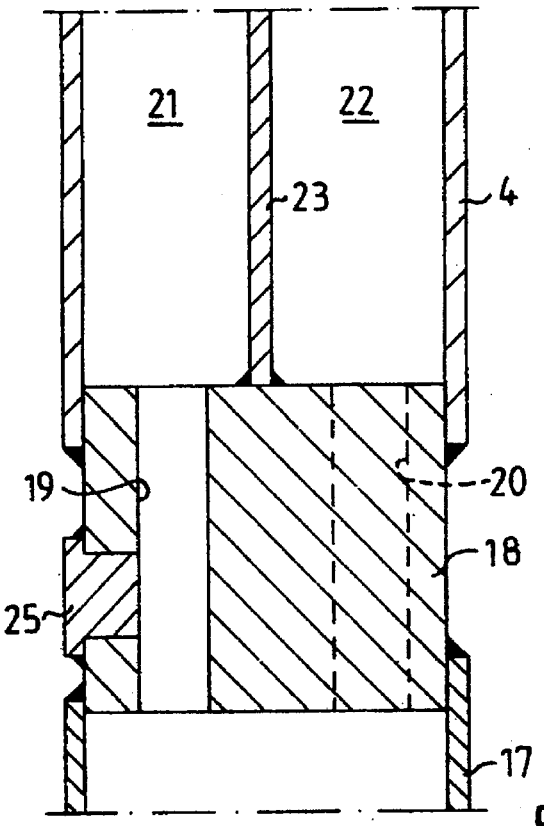
FIGS. 6A and 6B show a cross-section through a screen ring and illustrate a way to change the capacity in the diffuser according to the invention.
Figure 6A:
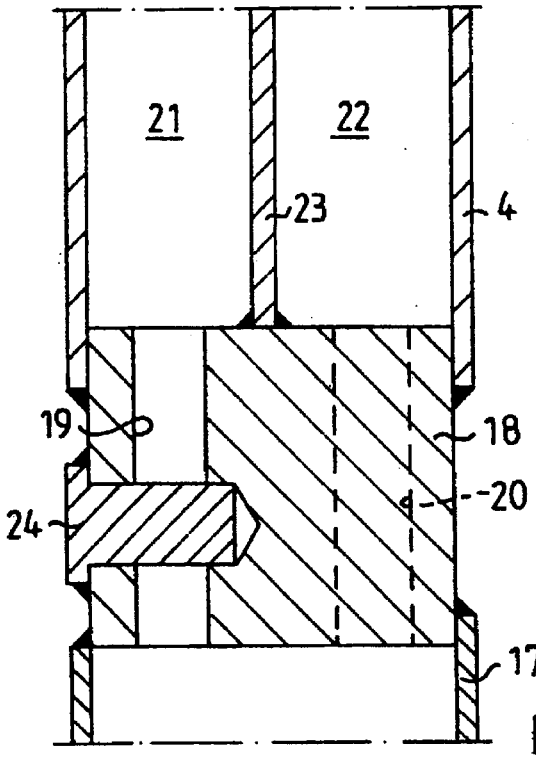

In order subsequently to be able to alter the restriction holes of the screen pack in the event of permanently increased production, the ring is provided with extra restriction holes, which are plugged as shown in FIGS. 6*a* and 6*b*. Located between the screen ring 3, 4 and the header 17 is a circumferential part 18 having holes 19, 20, formed between the screen ring and the header, which holes, as can be seen from FIGS. 6*a* and 6*b*, connect up to the inner spaces 21 and 22 of the screen ring, which are divided by means of a partition 23. Upon delivery of the diffuser, a predefined number of holes, for example every other hole, is plugged up by means of a through plug 24 according to FIG. 6*a*. The diffuser is thereby matched to a capacity from the start amounting to around half of its maximum capacity. As requirements increase, these plugs 24 can be exchanged for short plugs 25, whereupon the flow through the screen pack can be increased up to maximum capacity according to FIG. 6*b*.

The nozzles 6" and 7" which are disposed at the centre of the diffuser 1 are disposed on the centre axle 12 of the lower nozzle arm 7 and are fed with fluid directly from the centre axle 12 and not via the nozzle arms 6 and 7. The flow of liquid through these nozzles can thus be made independent of the flow of liquid through the nozzle arms 6 and 7 and, preferably, a higher flow of liquid is produced than through other nozzles 6' and 7' to enable the pulp to pass easily those screen rings 3' and 4' disposed nearest the centre, which screen rings together form a cylinder right around the centre axle 12. This design minimizes the risk of the screen pack, i.e. the screen rings 3, 4 and the screen arms 5, and the centre axle 12 arresting each others' movements when the pulp is fed forward therebetween.

The diffuser according to the invention, as shown in FIGS. 1–5, having eight upper and lower screen rings and having six screen arms, is dimensioned for a capacity in the order of magnitude of 2000 tonnes of cellulose pulp throughput every 24 hours. In a diffuser of this kind, the screen rings each have a height of between 1000 and 1500 mm, preferably 1100 mm in the case of a single diffuser and 1450 in the case of a double diffuser. The diffuser I according to the invention is preferably made from stainless steel containing at least 12% Cr and can also contain at least 10% Ni and/or at least 1% Mo.

In previously known diffusers, the hydraulic piston and cylinder assemblies 10 for the movement of the screen pack are normally placed under the arm of the screen pack. This placement means that the cylinders are exposed to leakage from the above-situated stuffing box. By moving the piston and cylinder assemblies to the top side, they are placed in a sheltered position. The hydraulic drive assembly is expediently placed on an upper servicing level. By virtue of a divided casing at the centre of the screen pack, an assembly unit is obtained, complete with hydraulics and drive. This unit can be fitted and tested prior to final assembly.

A withdrawal pipe 26 is fixedly connected to the outer end of each screen arm 5 and is directed substantially downwards. The withdrawal pipes are guided telescopically through bearing bushes 27 disposed in recesses formed in the casing of the container 2, so that the withdrawal pipes open out into an outlet for filtrate. The outer ends of the screen arms 5 extend into an annular bulge 28 in the wall of the container, in which bulge the withdrawal pipe extends substantially vertically downwards through the bush 27. It is also possible to configure a bulge 28 in the wall of the container 2 right in front of each screen arm.

As can be seen from the drawings, the withdrawal pipes 26 and the piston and cylinder assemblies 10 are disposed on either side of the outer ends of the screen arms 5. It is also possible, within the scope of the appended patent claims, to direct the withdrawal pipes upwards and mount them in control bushes arranged at the top, in which case the piston and cylinder assemblies can then be disposed under or over the screen arms. It is most advantageous, on the other hand, for the withdrawal pipe and piston and cylinder assembly to be arranged as illustrated in the drawings, this by virtue of the fact that a stable raising and lowering of the screen park can thereby occur, at the same time as the filtrate cannot significantly enter into contact with the bearing bushes through which the pipes are guided. Moreover, leak medium from the diffuser does not reach the hydraulic cylinder when this is mounted above the screen arm. As a result of the pressure from the pulp located above the screen pack, a flow-pressure is generated upon the filtrate. The withdrawal pipes can thereby readily be placed above the screen arms and the longitudinal section of the withdrawal spaces does not have to be adapted for the running-off of filtrate, but rather the filtrate is forced automatically out of the outlets of the diffuser at the bushes 27.

Pull rods 29, which are connected by means of a coupling 30 to the piston rod 31 in each piston and cylinder assembly 10, are flexibly connected at their lower end, by means of a ball joint 32, to the outer ends of each screen arm 5 within the bulge 28 in the wall of the container 2. Each pull rod 29 passes through the wall of the container via a seal-forming stuffing box 33, described in greater detail below, which is floatingly mounted, i.e. accompanies the movement of the rod 29 in the lateral direction whenever the screen pack is raised or lowered, and which is arranged in a pipe which is disposed on and is joined to the said bulge 28. As a result of the arrangement of the floating stuffing box 33, no bending forces are transmitted to the cylinder or pull rod. The piston and cylinder assemblies 10 are flexibly connected at their upper end, by a ball joint 34, to the outer side of the container. The control and vertical movement of the screen pack allows the screen pack to tilt corresponding to the stroke length, without damage to machine parts.

Figure 7:
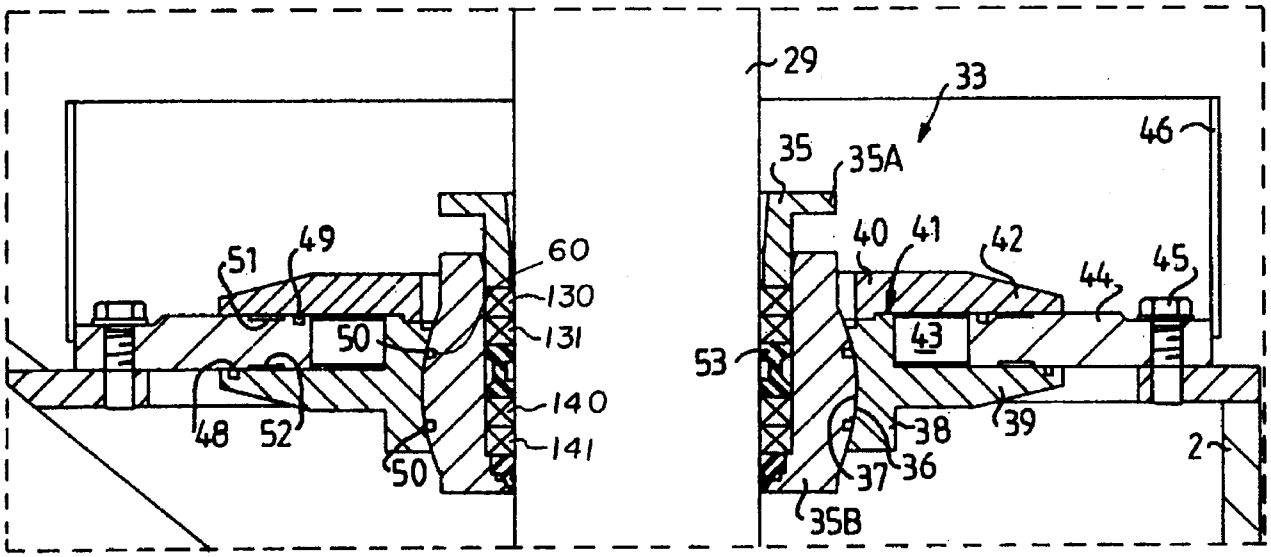
FIG. 7 shows a cross-section through a first embodiment of a stuffing box.
Figure 8:
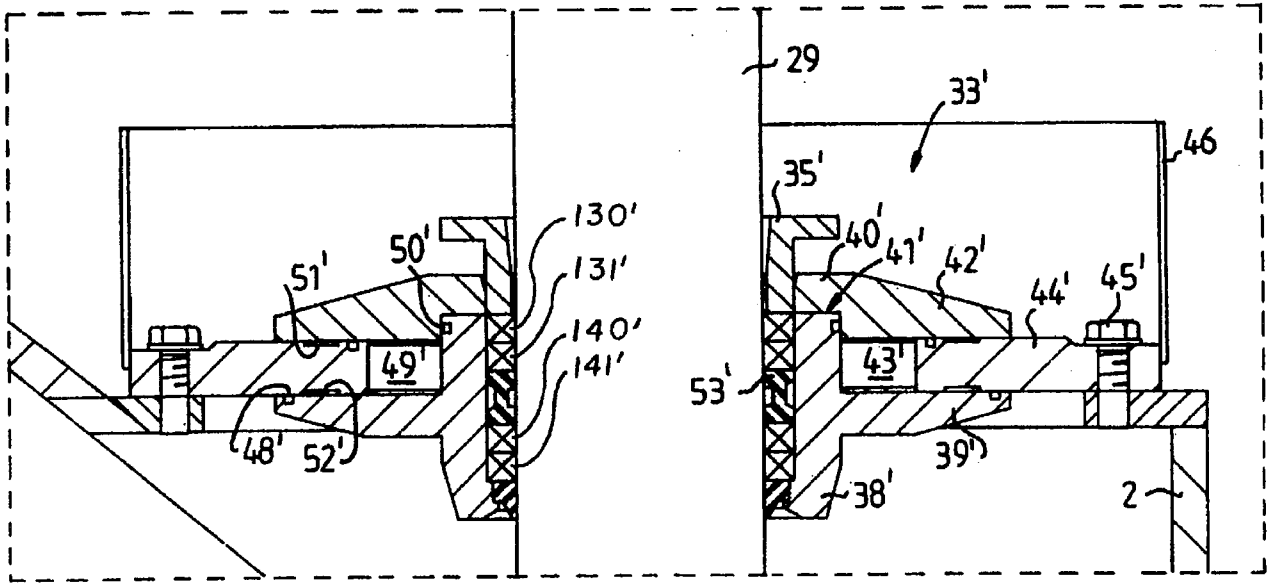
FIG. 8 shows a cross-section through a second embodiment of a stuffing box.

In FIGS. 7 and 8 there is shown, on a larger scale, two embodiments of the stuffing boxes 33 and 33', which are mounted such that the pull rod 29 can be displaced in the lateral direction if the pull rod is acted upon by radial forces.

In the case of the stuffing box 33 according to the embodiment in FIG. 7, the cylindrical fixture 35 of the stuffing box, which cylindrical fixture bears against the pull rod, is constituted by an inner part 35A which seals against the rod and an outer part 35B, having an outer spherical contacting surface 36, which is mounted in a spherical bearing shell 37 belonging to a lower, circumferential supporting part 38, this being provided with a circumferential, radially directed, lower flange 39. An upper, circumferential supporting part 40 is fixed to the lower supporting part 38 at 41 and comprises a circumferential, radially directed, upper flange 42. Between the lower and upper flanges 39 and 42 there is formed an annular space 43, in which there is inserted a circumferential, radially directed bearing flange 44. The circumferential flange is fixed at its outer circumferential edge, by means of a bolt connection 45, to the wall of the container 2.

A collecting box 46 for the collection of leak fluid is disposed right around the pull rod above the stuffing box 33.

The stuffing box can, of course, be mounted differently from the arrangement shown in the drawings, the main point being that it is able to move freely and in sealing arrangement in the radial direction, at the same time as the pull rod guided through the stuffing box is allowed to perform a rocking movement in all directions. A rotary movement of the rod extending through the stuffing box is also possible. The two parallel flanges 39 and 42 can thus be fixed to the wall of the container, or to a stationary frame, and the circumferential, radially directed bearing flange can constitute a part of or be fixed to a supporting part provided with an inner spherical bearing, which supporting part is mounted on the inner part.

As can be seen from the embodiment of the stuffing box 33' according to FIG. 8, the spherical bearing can be relinquished, in which case the fixture 35' is directly connected to upper and lower supporting parts 40' and 38', which are fixed to each other at 41' and bear flanges 42' and 39', respectively. The radially directed, circumferential bearing flange 44' is fixed by means of a bolt connection 45' to the wall 2 of the container and extends into the space 43' between the upper and lower flanges 42' and 39'. Here too, a collecting box 46' for leak fluid is disposed around the pull rod 29.

From the two embodiments of the stuffing box 33 and 33' according to FIGS. 7 and 8, it can be seen that circumferential grooves 48, 49 and 50 and 48', 49' and 50' are formed for seal forming O-rings 60. 51, 52 and 51', 52' denote upper and lower sliding elements. An annular seal 53 or 53' is disposed, for sealing of the rod, in the fixture 35 or 35',which bears and seals against the rod and is mounted such that it is slidably displaceable. The annular seal 53 illustrated in FIG. 7 is mounted between upper bearings 130 and 131 and lower bearings 140 and 141. The annular seal 53' illustrated in FIG. 8 is mounted between upper bearings 130' and 131' and lower bearings 140' and 141'. The upper and lower supporting parts, as indicated above, are fixed to each other as shown in the drawings. It is possible, or course, within the scope of the appended patent claims, instead of two supporting parts, to have the stuffing box comprise just one supporting part.

The stuffing box shown in the drawings is not limited to use in a diffuser according to the invention, but can find other applications as a stuffing box designed for a rod, which stuffing box shall be able to perform a forward and reverse and/or rotary movement and which shall be able to absorb lateral forces acting against the rod. A predefined rocking movement in respect of the rod guided through the stuffing box can also be possible.

The diffuser according to the invention is not limited, of course, to the embodiment described above and shown in the drawings, but can be modified within the scope of the appended patent claims. The same applies, of course, to the stuffing box defined in the appended patent claims.

We claim:

1. A stuffing box designed to receive a rod for raising and lowering a screen pack having screen surfaces in a diffuser, the rod being guided in sealing arrangement and slidably through a fixture, characterized that the fixture is mounted in a bearing, the bearing being freely linearly moveable in a plane substantially perpendicular to the rod, and in that the bearing comprises a radially directed bearing flange extending around the fixture, which bearing flange is mounted between two radially directed retaining flanges extending around the fixture, and a seal is mounted between the bearing flange and one of the two retaining flanges to form a seal therebetween.

2. A stuffing box according to claim 1, characterized in that the fixture bears, via at least one sealing ring, against the rod, in that between the fixture and a circumferential supporting part arranged outside the fixture there is disposed a spherical bearing, so that the rod is allowed to perform rocking movements, and in that one of the bearing flange and the two retaining flanges is fixedly connected to the supporting part.

3. A stuffing box according to claim 2, characterized in that the spherical bearing is constituted by spherical complementary surfaces on the fixture and the support part, which surfaces bear slidably against each other and form a seal.

4. A stuffing box according to claim 1, characterized in that the fixture bears, via at least one sealing ring, against the rod, and in that one of the bearing flange, and the retaining flanges is fixedly connected to the fixture.

5. A stuffing box for use with a diffuser, the diffuser having a pull rod, comprising:

a bearing having a body with a first flange extending radially from said body;

a fixture mounted in said body of said bearing, said fixture having an aperture adapted to slideably receive the pull rod for axial movement of the pull rod relative to said fixture;

a second flange mountable to the diffuser to engage said bearing, said bearing being freely linearly moveable relative to said second flange in a plane parallel to said first flange with said first flange slideably engaging said second flange; and a seal positioned between the first flange and the second flange to form a seal therebetween.

6. The stuffing box of claim 5 wherein said fixture includes inner and outer portions, said outer portion being radially outward of said inner portion and in engagement with said bearing, said outer portion having a spherical outer surface, and said bearing having a spherical inner surface that slideably engages said spherical outer surface of said outer portion.

7. The stuffing box of claim 6 further comprising a seal between said bearing spherical inner surface and said fixture outer portion.

8. The stuffing box of claim 5 wherein said first flange comprises an upper flange member and a lower flange member, and said second flange extends between said upper flange member and said lower flange member.

9. The stuffing box of claim 5 further comprising a sealing ring between the rod and said fixture, said sealing ring forming a seal between the rod and said fixture.

10. The stuffing box of claim 9 wherein said sealing ring is mounted to said fixture.

11. The stuffing box of claim 5 wherein the seal positioned between said first flange and said second flange is an O-ring.

12. The stuffing box of claim 5 wherein the first flange comprises a sliding element that slidably engages the second flange.

13. The stuffing box claim 5 wherein the second flange comprises a sliding element that slidably engages the first flange.

14. The stuffing box of claim 5 wherein the fixture additionally comprises bearing elements that slideably engage the pull rod.

* * * * *